US005516459A

United States Patent [19]

Van Eenam

[11] Patent Number: 5,516,459

[45] Date of Patent: May 14, 1996

[54] AIRCRAFT CLEANING/DEGREASING COMPOSITIONS

[75] Inventor: Donald N. Van Eenam, Des Peres, Mo.

[73] Assignee: Buckeye International, Inc., Maryland Heights, Mo.

[21] Appl. No.: 289,754

[22] Filed: Aug. 12, 1994

[51] Int. Cl.[6] ..... C11D 1/75; C11D 3/12; C11D 3/37

[52] U.S. Cl. ..... 252/547; 252/156; 252/173; 252/174.23; 252/174.25; 252/DIG. 2

[58] Field of Search ..... 252/156, 547, 252/173, 174.25, 174.23, 174.24, DIG. 2; 134/2, 40

[56] References Cited

U.S. PATENT DOCUMENTS

| | | | |
|---|---|---|---|
| 4,271,030 | 6/1981 | Brierley et al. | 252/174.25 |
| 4,287,080 | 9/1981 | Siklosi | 252/104 |
| 4,559,159 | 12/1985 | Denzinger et al. | 252/174.23 |
| 4,740,327 | 4/1988 | Julemont et al. | 252/156 |
| 5,232,622 | 8/1993 | Jones et al. | 252/DIG. 2 |
| 5,368,843 | 11/1994 | Rennie | 252/174.23 |
| 5,376,297 | 12/1994 | Choy et al. | 252/174.25 |

FOREIGN PATENT DOCUMENTS

| | | |
|---|---|---|
| 651634 | 10/1965 | Belgium . |
| 0595590 | 5/1994 | European Pat. Off. . |
| 61-113697 | 5/1986 | Japan . |
| 7204495 | 10/1972 | Netherlands . |

*Primary Examiner*—Linda Skaling Therkorn
*Assistant Examiner*—Caroline L. Dusheck
*Attorney, Agent, or Firm*—Senniger, Powers, Leavitt & Roedel

[57] ABSTRACT

Stable, cleaning/degreasing compositions for heavy duty exterior and interior aircraft cleaning and degreasing consisting essentially of (a) between approximately 0.5 and 10.0 weight percent of a specified tertiary amine N-oxide surfactant;

(b) between approximately 0.5 and 5.0 weight percent of a specified water-dilutable, soluble or hydrocolloidally dispersable viscosifying agent;

(c) between approximately 1 and 10 weight percent of an alkali metal silicate;

(d) between approximately 0.1 and 1.0 weight percent of an alkali metal nitrite; and (e) water.

The compositions are characterized by having a pH between approximately 10.5 and 13.3 and a Brookfield viscosity (LV-#3 spindle, 12 rpm) of between approximately 500 and 20,000 centipoise. Such compositions exhibit superior efficacy for heavy duty exterior and interior aircraft cleaning and degreasing a variety of surfaces without metal corrosion or stress crazing.

25 Claims, No Drawings

AIRCRAFT CLEANING/DEGREASING COMPOSITIONS

BACKGROUND OF THE INVENTION

This invention relates to cleaning degreasing compositions and more particularly, stable, cleaning/degreasing compositions for use for heavy duty exterior and interior aircraft cleaning and/or degreasing which exhibit superior cleaning and degreasing capability.

Heretofore, most conventional aircraft cleaning/degreasing compositions have been formulated to contain one or more organic hydrocarbon solvents or are citrus or butyl-based (e.g. contain 2-butoxyethanol). Such compositions suffer from serious drawbacks in that they create noxious odors, release volatile organic compounds, cause skin irritation, breathing difficulties and other health problems and may, as well, be flammable or combustible. Moreover, such compositions are not uniformly adapted for efficacious heavy duty exterior and interior aircraft cleaning/degreasing. Further, conventional aircraft cleaning/degreasing compositions are generally non-biodegradable, present fire hazards and are capable of creating aircraft metal corrosion problems and/or plastic crazing.

There remains a need, therefore, for heavy duty exterior and interior aircraft cleaning/degreasing compositions with improved cleaning and degreasing efficacy for various exterior and interior aircraft surfaces and the soilants thereon and which avoid the deficiencies of presently available compositions.

SUMMARY OF THE INVENTION

Among the several objects of the invention may be noted the provision of stable cleaning/degreasing compositions having superior efficacy for heavy duty exterior and interior aircraft cleaning and degreasing; the provision of such compositions which avoid the use of organic solvents and which may be formulated to be essentially odorless; the provision of compositions of this type which can be effectively used for cleaning/degreasing a variety of surfaces found on the exterior and interior of aircraft; the provision of such compositions which avoid metal corrosion problems; the provision of such compositions which avoid stress crazing or other attack on transparent acrylic plastics; and the provizsion of such improved compositions which may be readily formulated in various viscosity ranges from available components. Other objects and features will be in part apparent and in part pointed hereinafter.

Briefly, the present invention is directed to stable, cleaning/degreasing concentrate compositions for use for heavy duty exterior and interior aircraft cleaning and/or degreasing the compositions comprise:

(a) between approximately 0.5 and 10 weight percent of a tertiary amine N-oxide surfactant of the formula:

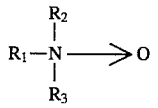

wherein $R_1$ contains a hydrophobe backbone having between 8 and 18 carbon atoms and is selected from the group consisting of alkyl, alkenyl, alkoxypropyl, or alkylamidoalkyl or alkenylamidoalkyl of the formula:

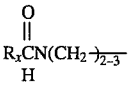

wherein $R_x$ is an alkyl or alkenyl hydrophobe backbone having between 8 and 18 carbon atoms, and $R_2$ and $R_3$ are selected from the group consisting of lower alkyl, hydroxethyl, hydroxypropyl or $R_2$ and $R_3$ constitute a cyclic morpholino, pyrridino or piperidino ring moiety;

(b) between approximately 0.5 and 5.0 weight percent of a water-dilutable, soluble, or hydrocolloidally dispersable viscosifying agent selected from the group consisting of acrylic acid/alkyl (meth)acrylate copolymers, carboxy acrylic polymers, polyacrylic acid crosslinked with polyalkenyl polyethers, polyacrylamide, poly(methylvinyl ether/maleic anhydride), xanthan gums, bentonite clays, magnesium aluminum silicates, polyethylene glycols, polyethylene oxide, poly(styrene/maleic anhydride), poly(ethylene/maleic anhydride), poly (2-acrylamido-2-methyl- 1-propanesulfonic acid) and poly(acrylic acid/acrylamide);

(c) between approximately 1 and 10 weight percent of an alkali metal silicate;

(d) between approximately 0.1 acid 1.0 weight percent of an alkali metal nitrite; and (e) water;

said composition having a pH between approximately 10.5 and 13.3 and a Brookfield viscosity (LV-#3 spindle, 12 rpm) of between approximately 500 and 20,000 centipoise when ready for use.

The invention is also directed to such compositions further diluted with water to the range between 1 part concentrate composition: 2 parts water and 1 part concentrate composition: 16 parts water and having a Brookfield viscosity (LV-#2 spindle, 60 rpm) of between approximately 5 and 25 centipoise.

DESCRIPTION OF THE PREFERRED EMBODIMENTS

In accordance with the present invention, it has now been found that stable, cleaning/degreasing compositions for use for heavy duty exterior and interior aircraft cleaning and/or degreasing and which are solvent-free and exhibit superior efficacy can be formulated by combining between approximately 0.5 and 10 weight percent of certain tertiary amine N-oxide surfactants, between approximately 0.5 and 5 weight percement of certain water-dilutable, soluble viscosifying agents, between approximately 1 and 10 weight percent of an alkali metal silicate, between approximately 0.1 and 1.0 weight percent of an alkali metal nitrite and water, the compositions having a pH between approximately 10.5 and 13.3 and a Brookfield viscosity (LV-#3 spindle, 12 rpm) of between approximately 500 and 20,000 centipoise when ready for use. Surprisingly, such compositions containing no solvent component exhibit superior cleaning/degreasing efficacy for a variety of metal, plastic, fabric and other surfaces found on the exterior and interior of aircraft.

A key component in the novel cleaning/degreasing compositions of the invention is a tertiary amine N-oxide surfactant of the formula:

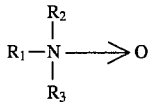

wherein $R_1$ contains a hydrophobe backbone having between 8 and 18 carbon atoms and is selected from the group consisting of alkyl, alkenyl, alkoxypropyl, or alkylamidoalkyl or alkenylamidoalkyl of the formula:

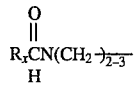

wherein $R_x$ is an alkyl or alkenyl hydrophobe backbone having between 8 and 18 carbon atoms, and $R_2$ and $R_3$ are selected from the group consisting of lower alkyl, hydroxyethyl, hydroxypropyl or $R_2$ and $R_3$ constitute a cyclic morpholino, pyrridino or piperidino ring moiety. This particular class of surfactants has been unexpectedly found to have especially effective wetting, penetrating and solvolytic properties required for potent, effective cleaning of oily, greasy soilants found on the exterior and interior of aircrafts. Among the specific surfactants of the above class or type which may be advantageously utilized in the practice of the invention may be mentioned cocodimethylamine N-oxide, lauryldimethylamine N-oxide, oleyldimethylamine N-oxide, dodecyldimethylamine N-oxide, octyldimethylamine N-oxide, bis-(hydroxyethyl)isodecyloxypropylamine N-oxide, decyldimethylamine N-oxide, cocamidopropyldimethylamine N-oxide, bis(hydroxyethyl) $C_{12-15}$ alkoxypropylamine N-oxide (e.g. AO-728 Special, Tomah Products, Exxon Chemical America), lauramine N-oxide, lauramidopropyldimethylamine N-oxide, $C_{14}$–$C_{16}$ alkyldimethylamine N-oxide, N,N-dimethyl (hydrogenated tallow alkyl) amine N-oxide (e.g. Aromax DMHT, Akzo Chemicals, Inc., tallow $=C_{14}$–$C_{18}$), isostearamidopropyl morpholine N-oxide and isostearamidopropyl pyrridine N-oxide. The use of cocodimethylamine N-oxide, lauryldimethylamine N-oxide and oleyldimethylamine N-oxide is preferred. It will be understood that other surfactants of the above-noted class and mixtures of such surfactants may also be employed in the practice of the invention.

The water-dilutable, soluble, or hydrocolloidally dispersable viscosifying agent component of the novel compositions of the invention is selected from the group consisting of acrylic acid/alkyl (meth)acrylate copolymers, carboxy acrylic polymers, polyacrylic acid crosslinked with polyalkenyl polyethers, polyacrylamide, poly(methylvinyl ether/maleic anhydride), xanthan gums, bentonite clays, magnesium aluminum silicates, polyethylene glycols, polyethylene oxide, poly ( styrene/mateic anhydride ) , poly(ethylene/maleic anhydride), poly (2-acrylamido-2-methyl-1-propanesulfonic acid) and poly (acrylic acid/acrylamide).

The preferred viscosifying agents for use in the practice of the invention are acrylic acid/alkyl(meth) acrylate copolymers sold under the trade designations "Acusol 820" by Rohm & Haas Co. and "Alcogum SL-78" by Alco Chemical, Division of National Starch & Chemical Co. Other specific viscosifying agents of the above types include carboxy acrylic polymers such as those sold under the trade designations "Carbopol 690" and "Carbopol 980" by B. F. Goodrich Chemical Co., xanthan gums such as those sold under the trade designations "Rhodopol 50 MD" by R. T. Vanderbilt Co. and "Kalzan AR" by Kelco Div. Merck Co., poly(2-acrylamido-2-methyl- 1-propanesulfonic acid) such as sold under the trade designation "Rheothik 80-11" by Henkel Corp., methyl vinyl ether/maleic anhydride copolymer such as that sold under the trade designation "Gantrez AN-179" by ISP Technologies, Inc., carboxyvinyl polymer such as that sold under the trade designation "Polygel DA" by 3V Corp., and colloidal magnesium aluminum silicate such as that sold under the trade designation "Van Gel ES" by R. T. Vanderbilt Co. Various other viscosifying agents of the classes described above may also be used in carrying out the practice of the invention. The viscosifying agents utilized in the practice of the invention are nonsurfactant types as compared to amine oxide/anionic surfactant blends which associatively self-thicken to useful viscosities but do not provide useful or efficacious cleaning/degreasing compositions. As shown by the working examples set forth hereinafter, the viscosifying agent component of the novel compositions of the invention imparts the necessary viscosity characteristics to provide the desired cling properties to the compositions for use in heavy duty aircraft cleaning/degreasing.

The alkali metal silicate component of the composition functions as a builder/corrosion inhibitor and preferably is constituted by a sodium or potassium metasilicate, orthosilicate, or other water-soluble silicate.

As a metal and metal alloy corrosion inhibitor, the compositions of the invention also contain an alkali metal nitrite such as sodium or potassium nitrite.

In addition to the above-noted components of the compositions of the invention, various optional adjuvants can be incorporated. These include fragrances, dyes, opacifiers, chetants (such as Hampene 100 or Versene 100), primary, secondary and tertiary amines as acid scavengers and solubilizers, and foam control additives.

In accordance with the invention, the cleaner/degreaser compositions have a pH between approximately 10.5 and 13.3 and preferably between 11.5 and 12.5. If the pH exceeds the stated upper limit, corrosion of metal or metal alloy surfaces being treated may occur. If the pH falls below the stated lower limit, the cutting power provided by the silicate builder/inhibitor component tends to diminish and deposition of insoluble siliceous matter on surfaces may occur.

As prepared, the cleaning/degreasing compositions of the invention in concentrate form advantageously possess a Brookfield viscosity (LV-#3 spindle, 12 rpm) of between approximately 500 and 20,000 centipoise. At viscosities within this range, the compositions and a 1:1 dilution thereof with water exhibit excellent to good vertical cling properties rendering them especially useful for heavy duty exterior aircraft cleaning and/or degreasing of metal and metal alloy surfaces bearing grease, hydraulic fluid and various oily/greasy soilants. Compositions having a Brookfield viscosity (LV-#3 spindle, 12 rpm) of between 2,500 and 4,500 centipoise exhibit excellent vertical cling properties. Dilutions of the concentrate compositions with water to the range between 1 part composition: 4 parts water and 1 part composition: 16 parts water produces compositions having a Brookfield viscosity (LV-#2 spindle, 60 rpm) of between approximately 5 and 25 centipoise which exhibit fair to slight vertical cling properties or are fluid. Such diluted compositions are especially useful in removing various soilants such as smudge marks, fingerprints, scuff marks and light grease and oil spots from interior aircraft surfaces such as vinyl headliner/paneling, vinyl fabric, nylon carpeting, and window paneling (both glass and acrylic).

For optimum results, the compositions of the invention contain between approximately 0.5 and 10.0 weight percent, preferably between approximately 1.5 and 2.0 weight percent, of the tertiary amine N-oxide surfactant component, between approximately 0.5 and 5.0 weight percent, preferably between approximately 0.7 and 1.2 weight percent, of the viscosifying agent component, between approximately 1 and 10 weight percent, preferably between approximately 2 and 3 weight percent, of the alkali metal silicate component, between approximately 0.1 and 1.0 weight percent, preferably approximately 0.5 weight percent of the alkali metal nitrite component, and the balance water.

The use of a combination of an alkali metal silicate and an alkali metal nitrite within the ranges herein specified has been found to provide unique advantages. Not only does the alkali metal silicate builder provide thickener neutralizing base and boost detersive action of the amine oxide surfactant component, but it along with the alkali metal nitrite provides full spectrum metal, metal alloy, and metal on metal coating corrosion inhibition and protection. While many conventional aircraft cleaners contain phosphate and/or condensed (poly)phosphate builders (often in combination with other alkaline builders), I have found that the presence of such phosphates and polyphosphates promotes corrosion rather than protection.

The cleaning/degreasing compositions of the invention display excellent chemical and physical (e.g. viscosity) stabilities in excess of at least six months under ambient temperature conditions and preferably up to one year. Other widely known hydrocolloidal thickeners, including various cellulosic types, e.g. hydroxyethyl cellulose, sodium carboxymethyl cellulose, and hydroxypropyl methylcellulose do not provide viscosity stable compositions and consequently are not suitable for use as viscosifying agents in the practice of the invention.

As shown by the working examples set forth hereinafter, the compositions of the invention may be conveniently prepared by adding the viscosifying agent to water with stirring, adding the alkali metal silicate and alkali metal nitrite components thereto with stirring followed by the addition of the tertiary amine N-oxide surfactant component with continued stirring. Other procedures or variations of the above-described procedure are illustrated in the working examples set forth hereinafter.

As shown by the experimental test data presented below the compositions of the invention provide superior cleaning/degreasing efficacy in removing various soilants from exterior and interior aircraft surfaces, do not contain objectionable solvents, and are adapted to be formulated in a range of viscosities for use on various exterior and interior aircraft surfaces.

The following examples illustrate the practice of the invention.

EXAMPLE 1

In the following examples of illustrative cleaner/degreaser compositions of the present invention, the compositions were subjected as indicated to the definitive, semi-quantitative degreasing test method described below in order to measure their cleaning/degreasing efficacy.

A magnetic stirrer (Fisher Scientific Co., Catalog No. 14-511-1A) provided with a vaned disc magnetic stir bar (⅞" (diameter) × ⅝" (height), 22 mm × 15 mm, Fisher Scientific Co., Catalog No. 14-511-98C) was used. In each instance, pre-cleaned, borosilicate glass microslides (3"×1", 1.0 mm thickness) were thinly smeared/rub-on coated with Vaseline brand white petroleum jelly on one side only to a distance of 1.0" from the bottom edge to provide a 1.0"×1.0" coated area. The test cleaner/degreaser solutions were employed at full strength unless otherwise indicated and in an amount sufficient to fill a 50 ml Pyrex beaker containing the vaned disc magnetic stirrer bar to a level of 40 ml. Each test solution and surrounding air were maintained at 21±0.5° C. and the test solution stirring rate was determined by a setting of "3" on the stirrer dial of the magnetic stirrer. The stirring disc was positioned off-center to accommodate each microslide, touching neither the beaker walls nor the microslide and rotating freely when in use. The microslide, in each test, rested upright on the beaker bottom, was allowed to lean against the lip of the beaker at an approximately 75° angle and was positioned with the Vaseline coated face or area facing upward away from the vaned disc magnetic stirrer bar.

For each test, the beaker containing the stirrer bar was filled to 40 ml. with the test cleaning/degreasing solution at the indicated concentration, placed atop the magnetic stirrer plate, and positioned off-center to accommodate the glass microslide, and yet allow the vaned disc stirrer bar to rotate or spin freely. The stirrer was turned on, the dial adjusted manually to the "3" stirring rate setting and the Vaseline thin film coated glass microslide was introduced into the test solution bath in such a manner that the coated side faced upward and was positioned away from the stirrer bar. The time "0" was noted immediately on a watch or clock with a sweep second hand.

At appropriate time intervals, the glass microslide was briefly removed from the cleaner/degreaser solution bath and immediately "read" for "% Vaseline removed from the 1.0"×1.0" treated area", an objective determination, after which the microslide was immediately returned to the stirred aqueous cleaner/degreaser bath. The duration of the degreasing test is determined by the time needed for complete, 100% removal of the Vaseline film from the glass microslide surface.

The accuracy of the above-described test method is of the order of ±5% as determined by replicate run averaging.

EXAMPLE 2

A stable, cleaning/degreasing concentrate formulation for heavy duty exterior and interior aircraft cleaning and/or degreasing was prepared having the following composition:

| Component | Wt. % |
|---|---|
| Cocodimethylamine N-oxide (Mackamine CO, MacIntyre Ltd., 30% actives) | 5.0 |
| Acrylic acid/alkyl (meth)acrylate copolymer (Acusol 820, 30% actives, Rohm & Haas Co.) | 3.75 |
| Sodium metasilicate.$5H_2O$ | 2.0 |
| Sodium nitrite | 0.5 |
| Soft $H_2O$ | 88.75 |
| | 100.00 |

The Acusol 820 viscosifying polymer was added to water with stirring. While stirring, the sodium metasilicate and sodium nitrite were added followed by the addition of the cocodimethylamine N-oxide with stirring to uniformity. The resulting composition was a clear, bluish irridescent semi-gel having a pH of 12.0 and a Brookfield viscosity (LV-#3 spindle, 12 rpm) of 1300 centipoise (day 0); 3050 centipoise (day 2) and 3600 centipoise (day 14).

The composition was employed in the following semi-quantitative oily/greasy soilant removal tests.

A. Removal of Oily/Greasy Soilants on Baked Enamelled Steel Surfaces.

The following soilants were applied side by side as smears to a flat baked-on-enamelled steel surface:

Texaco Motor Gear Lube Premium

Black felt tip Magic Marker

Skydrol hydraulic fluid, Grade LD-4

Red (wax) china marker

#1 Graphite pencil

Takalube Outside Gear Lube (grease)

Mobile 28 Lithium Grease (synthetic)

Blue ballpoint pen

The above soilants were wetted with the above-noted concentrate composition, given a 30 second hold period to allow for penetration of the composition and then lightly wiped with a shop towel wetted with the composition for 10–15 seconds in a back and forth motion. All of the above soilants were fully removed from the enamelled surface and taken up by the wetted towel, i.e. there was 100% removal of the soilants.

The same results were achieved with 1:1, 1:2 and 1:4 dilutions of the concentrate composition with water.

B. Cleaning of Interior Soiled Surfaces.

Using the above-prepared concentrate composition diluted 1:10 and 1:16 with water applied to provide wetted, wrung-out shop towels, the following soilant types were readily removed from surfaces such as vinyl headliner/paneling, vinyl fabric, nylon carpeting, window paneling, (glass and acrylic) and similar surfaces by employing a wiping motion:

Smudge marks

Fingerprints

Scuff marks

Light grease and oil spots

The following table provides a viscosity/concentration/solution/pH profile of the concentrate composition and diluted forms thereof:

| Concentration | Viscosity (Brookfield) | pH | Comments |
|---|---|---|---|
| Concentrate | 3600 centipoise (LV-2, 6 rpm) | 12.0 | Excellent vertical cling |
| 1:1 | 620 centipoise (LV-2, 30 rpm) | 11.63 | Good vertical cling |
| 1:2 | 130 centipoise (LV-2, 30 rpm) | 11.48 | Fair vertical cling |
| 1:4 | 22 centipoise (LV-2, 60 rpm) | 11.29 | Slight vertical cling |
| 1:8 | 11.5 centipoise (LV-2, 60 rpm) | 11.12 | Slight vertical cling |
| 1:16 | 6.25 centipoise (LV-2, 60 rpm) | 10.85 | Fluid |

The clear delineation between the concentrate, 1:1 and 1:2 dilution concentrations and the 1:4 and more dilute concentrations allows for effective exterior and interior aircraft cleaning, respectively, under ideal conditions.

C. The concentrate composition diluted 1:8 with water was subjected to the degreasing test method of Example 1 with the following results:

1st attack on greased slide at 1 sec.

35–40% removal of grease at 10 sec.

70% removal of grease at 20 sec.

90–95% removal of grease at 30 sec.

100% removal of grease at 35 sec.

At a dilution of 1:16 with water, the results were:

1st attack on greased slide at 3 sec.

35–40% removal of grease at 30 sec.

55% removal of grease at 1.0 min.

70–75% removal of grease at 1.5 min.

90% removal of grease at 2.0 min.

100% removal of grease at 2.33 min.

EXAMPLE 3

A stable, cleaning/degreasing concentrate formulation for heavy duty exterior and interior aircraft cleaning and/or degreasing was prepared having the following composition:

| Component | Wt. % |
|---|---|
| Cocodimethylamine N-oxide (Mackamine CO, MacIntyre Ltd., 30% actives) | 5.0 |
| Acrylic acid/alkyl (meth)acrylate copolymer (Acusol 820, 30% actives, Rohm & Haas Co.) | 4.0 |
| Sodium metasilicate.$5H_2O$ | 2.0 |
| Sodium nitrite | 0.5 |
| Soft $H_2O$ | 88.5 |
| | 100.0 |

The composition was prepared as described in Example 2 and had a pH of 12.1 and a Brookfield viscosity (LV-#3 spindle, 12 rpm) of 1500 centipoise.

The composition was employed in the same tests described in Example 2 with similar results.

EXAMPLE 4

A stable, cleaning/degreasing concentrate formulation for heavy duty exterior and interior aircraft cleaning and/or degreasing was prepared having the following composition:

| Component | Wt. % |
|---|---|
| Cocodimethylamine N-oxide (Mackamine CO, MacIntyre Ltd., 30% actives) | 5.0 |
| Acrylic acid/alkyl (meth)acrylate copolymer (Acusol 820, 30% actives, Rohm & Haas Co.) | 3.5 |
| Sodium metasilicate.$5H_2O$ | 2.0 |
| Sodium nitrite | 0.5 |
| Soft $H_2O$ | 89.0 |
| | 100.0 |

The composition was prepared as described in Example 2 and had a pH of 12.2, a Brookfield viscosity (LV-#3 spindle, 12 rpm) of 1200 centipoise (day 0) and a Brookfield viscosity (LV-#3 spindle, 12 rpm) of 2450 centipoise (day 14).

The composition was employed in the same tests described in Example 2 with similar results.

EXAMPLE 5

The compositions of Examples 2, 3 and 4 were subjected to the following corrosion test.

Magnesium metal coupons, cut to give ½"×2" pieces were positioned at an approximately 45° angle in 4 oz. 1½" inside diameter wide mouth glass bottles with paperlined black Bakelite lids. When or if corrosion occurs at a temperature of 100° C. over a 48 hour test period in the presence of the above-noted compositions of Example 2, 3 and 4, hydrogen is evolved and the coupon surfaces become coated with magnesium hydroxide (white).

When tested using this procedure, the compositions of Examples 2, 3 and 4 caused or exhibited no visible corrosion.

EXAMPLE 6

A-stable, cleaning/degreasing concentrate formulation was prepared having the following composition:

| Component | Wt. % |
|---|---|
| Cocodimethylamine N-oxide (30% actives) | 3.0 |
| Octyldimethylamine N-oxide (FMB AO-8, Huntington Labs, 40% actives) | 2.0 |
| Acrylic acid/alkyl (meth)acrylate copolymer (Acusol 820, 30% actives) | 3.75 |
| Sodium metasilicate.$5H_2O$ | 2.0 |
| Sodium nitrite | 0.5 |
| Soft $H_2O$ | 88.75 |
| | 100.00 |

The Acusol 820 was added to water with stirring followed by the addition of the sodium metasilicate and sodium nitrite which caused instant thickening. Finally, the two N-oxide compounds were added with stirring. The resulting concentrate composition was a clear, bluish, irridescent, odorless, aqueous pseudo gel having a pH of 12.17 and a Brookfield viscosity (LV-#3 spindle, 12 rpm) of 8450 centipoise. The composition exhibited excellent stability and vertical cling.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with the above composition with successful results. The concentrate composition diluted 1:8 with water was subjected to the degreasing that method of Example 1 and produced a 100% degreasing time of 40 seconds.

EXAMPLE 7

Example 6 was repeated to produce the following stable cleaning/degreasing composition:

| Component | Wt. % |
|---|---|
| Oleyldimethylamine N-oxide (Mackamine 02; McIntyre Group, Ltd. 35% actives) | 5.1 |
| Acusol 820 | 2.5 |
| Sodium metasilicate.$5H_2O$ | 1.4 |
| Sodium nitrite | 0.5 |
| Soft $H_2O$ | 90.5 |
| | 100.0 |

The procedure described in Example 6 was followed and the resulting composition was a clear, quite pronounced bluish, irridescent solution having a faint fatty odor, a pH of 12.25 and a Brookfield viscosity (LV-#3 spindle, 12 rpm) of 1500 centipoise. The composition was very stable and exhibited good/excellent vertical cling.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with the above composition with successful results. The concentrate composition diluted 1:8 with water was subjected to the degreasing test method of Example 1 and produced a 100% degreasing time of 32 seconds.

EXAMPLE 8

Example 6 was repeated to produce the following stable cleaning/degreasing composition:

| Component | Wt. % |
|---|---|
| Oleyldimethylamine N-oxide (35% actives) | 5.1 |
| Acusol 820 | 3.2 |
| Sodium metasilicate.$5H_2O$ | 1.8 |
| Sodium nitrite | 0.5 |
| Soft $H_2O$ | 89.4 |
| | 100.0 |

The procedure described in Example 6 was followed and the resulting composition was a clear, pronounced bluish, irridescent solution having a very slight fatty odor, a pH of 12.21 and a Brookfield viscosity (LV-#3 spindle, 12 rpm) of 3920 centipoise. The composition was very stable and exhibited excellent vertical cling.

The concentrate composition and 1:1, 1:2 and 1:4 dilutions thereof with water were subjected to the test described in Example 2A and 100% removal of the soilants was observed at each concentration for each of the listed smears and markings. The test procedures of Example 2B was repeated with the above composition with successful results. The concentrate composition diluted 1:8 with water was subjected to the degreasing test method of Example 1 and produced a 100% degreasing time of 40 seconds.

EXAMPLE 9

A stable cleaning/degreasing concentrate formulation was prepared having the following composition:

| Component | Wt. % |
|---|---|
| Bis-(hydroxyethyl) isodecyloxy-propylamine N-oxide (Tomah AO-14-2, Tomah Products, Exxon Chemical Americas, 50% actives) | 4.5 |
| Carboxy acrylic polymer (Carbopol 690, B. F. Goodrich Chemical Co., 1% aqueous solution) | 92.0 |
| Sodium metasilicate.$5H_2O$ | 3.0 |
| Sodium nitrite | 0.5 |
| | 100.0 |

The aqueous hydrocolloidal thickener solution was prepared as follows: To vigorously motor-driven 3-bladed impellor-stirred water (990 g.) contained in a 1500 ml beaker 10.0 g of Carbopol 690 powdered resin was slowly added during 3–4 minutes. The dispersed powder gradually went into colloidal solution within approximately 30 minutes stirring time. Stirring was then continued for a total elapsed time of 1.0 hour to complete its dissolution.

The metasilicate and nitrite were added to the aqueous Carbopol 690 solution (92.0 g) with stirring to produce a thickened colloidal solution to which was then added, with stirring, the A0-14-2 surfactant. The resulting composition was a thickened, colloidal translucent solution pseudo gel having a pH of 11.88 and a Brookfield viscosity (LV-#3 spindle, 12 rpm) of 2770 centipoise. The composition was very stable, exhibited excellent vertical cling and had a very mild odor.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with the above composition with successful results. The concentrate composition diluted 1:8 with water was subjected to the degreasing test method of Example 1 and produced a 100% degreasing time of 1.25 minutes.

EXAMPLE 10

Example 9 was repeated to produce the following stable cleaning/degreasing composition:

| Component | Wt. % |
|---|---|
| Lauryldimethylamine N-oxide (Ammonyx LO, Stepan Co., 30% actives) | 4.5 |
| Carbopol 690 (1.0% aqueous solution) | 91.8 |
| Sodium metasilicate.$5H_2O$ | 3.2 |
| Sodium nitrite | 0.5 |
| | 100.0 |

The procedure described in Example 9 was repeated and the resulting composition was an odorless, irridescent/colloidal pseudo gel having a pH of 12.13 and a Brookfield viscosity (LV-#3 spindle, 12 rpm) of 4100 centipoise. The composition was very stable and exhibited excellent vertical cling to surfaces.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition diluted 1:8 with water was subjected to the degreasing test method of Example 1 and produced a 100% degreasing time of 30 seconds.

EXAMPLE 11

A stable cleaning/degreasing concentrate formulation was prepared having the following composition:

| Component | Wt. % |
|---|---|
| Cocodimethylamine N-oxide (30% actives) | 4.5 |
| Xanthan gum (Rhodopol 50 MD, Dispersible Grade, R.T. Vanderbilt Co., 1% aqueous solution) | 94.0 |
| Sodium metasilicate.$5H_2O$ | 1.0 |
| Potassium nitrite | 0.5 |
| | 100.0 |

The aqueous hydrocolloidal thickener solution was prepared as follows: Into 990 g. of vigorously, 3-bladed impellor-stirred soft water was sifted 10.0 g. of Rhodopol 50 MD Xanthan gum powder during 1–2 minutes. To the stirred dispersion was then added 8–9 drops of aqueous ammonium hydroxide to raise the pH to approximately 8.5 resulting in rapid thickening/dissolution. Stirring was continued for a total time of 1 hour to provide a thickened, pale yellow colloidal solution.

The combined metasilicate and nitrite were added to the stirred aqueous colloidal solution (94.0 g) followed by the stirred addition of the cocodimethylamine N-oxide. The resulting composition was a colloidal, straw-colored, odorless pseudo gel having a pH of 12.38 and a Brookfield viscosity (LV-#3 spindle, 12 rpm) of 5450 centipoise (day 0), 5480 (day 7) and 5460 (day 30). The composition exhibited excellent stability and vertical cling.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with successful results. The concentrate composition diluted 1:8 with water was subjected to the degreasing test method of Example 1 and produced a 100% degreasing time of 25 seconds.

EXAMPLE 12

Example 9 was repeated to produce the following stable cleaning/degreasing composition:

| Component | Wt. % |
|---|---|
| Decyldimethylamine N-oxide (Mackamine C-10, McIntyre Group Ltd. 30% actives) | 4.5 |
| Carbopol 690 (1.0% aqueous solution) | 90.3 |
| Sodium metasilicate.$5H_2O$ | 3.2 |
| Potassium nitrite | 0.5 |
| | 100.0 |

The procedure described in Example 9 was repeated and the resulting composition was an essentially odorless, translucent, thixotropic solution having a pH of 12.02 and a Brookfield viscosity (LV-#3 spindle, 12 rpm) of 3960 centipoise. The composition was very stable and exhibited excellent vertical cling properties.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition diluted 1:8 with water was subjected to the degreasing test method of Example 1 and produced a 100% degreasing time of 30 seconds.

EXAMPLE 13

A stable cleaning/degreasing concentrate formulation was prepared having the following composition:

| Component | Wt. % |
|---|---|
| Potassium silicate (Kasil #6, PQ Corp., (39.15% aq. solution) | 4.5 |
| Potassium hydroxide, 45% | 1.7 |
| Potassium nitrite | 0.5 |
| Soft $H_2O$ | 2.8 |
| | 10.00 |

Kasil #6 is a potassium silicate aqueous solution having a $SiO_2/K_2O$ ratio of 2.10 and a pH of 11.7. Stirring the first three above-listed components into water produces a clear aqueous solution.

| | |
|---|---|
| Cocodimethylamine N-oxide (30% actives) | 4.0 |
| Acusol 820 (30% actives) | 4.2 |
| Soft $H_2O$ | 81.8 |
| | 100.0 |

The Acusol 820 was stirred into water and, while stirring, the 10.0 g. of the above-noted mixed salt solution was added to produce instant thickening. Finally, the cocodimethylamine N-oxide was added with stirring. The resulting composition is an odorless, bluish irridescent, viscous solution having a pH of 12.20 and a Brookfield viscosity (LV-#3 spindle, 12 rpm) of 4080 centipoise. The composition is very stable and exhibits excellent vertical cling properties.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% the degreasing time of 38 seconds.

EXAMPLE 14

A stable cleaning/degreasing concentrate formulation was prepared having the following composition:

| Component | Wt. % |
|---|---|
| Cocamidopropyldimethylamine N-oxide (Mackamine CAO, McIntyre Group Ltd., 30% actives) | 5.7 |
| Acusol 820 (30% actives) | 2.5 |
| Sodium metasilicate.$5H_2O$ | 1.3 |
| Sodium nitrite | 0.5 |
| Soft $H_2O$ | 90.0 |
| | 100.0 |

To stirred water was added in order, Acusol 820, the metasilicate and nitrite (with dissolution/immediate thickening) and the Mackamine CAO. The resulting composition was an odorless, bluish irridescent, semi gel-like solution having a pH of 11.98 and a Brookfield viscosity (LV-#3 spindle, 12 rpm) of 2660 centipoise. The composition was very stable and exhibited excellent vertical cling properties.

The above concentrate composition and 1:1, 1:2 and 1:4 dilutions thereof with water were subjected to the test described in Example 2A and 100% removal of the soilants was observed at each listed concentration for each of the smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 50 seconds.

EXAMPLE 15

A stable cleaning/degreasing concentrate formulation was prepared having the following composition:

| Component | Wt. % |
|---|---|
| Oleyldimethylamine N-oxide (Mackamine 02, 35% actives) | 4.0 |
| Poly(2-acrylamido-2 methyl-1-propanesulfonic acid)(Rheothik 80-11, Henkel Corp., 15% aq. solution) | 30.0 |
| Sodium metasilicate.$5H_2O$ | 2.0 |
| Sodium hydroxide | 1.2 |
| Sodium nitrite | 0.5 |
| Soft $H_2O$ | 62.3 |
| | 100.0 |

The Rheothik 80-11 was added to water with stirring until homogenous. Then, with stirring, the following were added in order: sodium hydroxide, metasilicate, nitrite and surfactant. The resulting composition was an essentially odorless, clear, colorless solution having a pH of 12.31 and a Brookfield viscosity (LV-#33 spindle, 12 rpm) of 1730 centipoise. The composition was very stable and exhibited good/excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 33 seconds.

EXAMPLE 16

A stable cleaning/degreasing concentrate formulation was prepared having the following composition:

| Component | Wt. % |
|---|---|
| Bis (hydroxyethyl) $C_{12-15}$alkoxypropylamine N-oxide (AO-728 Special, Tomah Products, Exxon Chemical America, 50% aq. solution) | 4.5 |
| Carbopol 980 (1.0% aq. solution) | 70.0 |
| Sodium metasilicate.$5H_2O$ | 2.5 |
| Sodium nitrite | 0.5 |
| Soft $H_2O$ | 22.5 |
| | 100.0 |

The water was added to the aqueous Carbopol 980. While stirring, the metasilicate and nitrite were added (with immediate thickening and dissolution) followed by the amine oxide with continued stirring. The resulting composition was a thick, translucent solution having a pH of 11.92 and a Brookfield viscosity (LV-#3 spindle, 6 rpm) of 9200 centipoise. The composition was very stable and exhibited excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of. Example 1 and produced a 100% degreasing time of 45 seconds.

EXAMPLE 17

A stable cleaning/degreasing concentrate formulation was prepared having the following composition:

| Component | Wt. % |
|---|---|
| Cocodimethylamine N-oxide (30% actives) | 4.0 |
| Xanthan gum (Rhodopol 50 MD, 1% aq. solution) | 86.5 |
| Sodium metasilicate.$5H_2O$ | 7.0 |
| Acetic acid | 2.0 |
| Sodium nitrite | 0.5 |
| | 100.0 |

With stirring, added in order to the aqueous xanthan gum solution were sodium metasilicate, sodium nitrite, acetic acid (to lower alkalinity) and the amine oxide. The resulting composition was a straw colored, translucent pseudo gel having a pH of 12.15 and a Brookfield viscosity (LV-#3 spindle, 12 rpm) of 5070 centipoise (day 0), 5500 (day 7) and 5490 (day 30). The composition exhibited excellent stability and vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 40 seconds.

EXAMPLE 18

Example 17 was repeated to produce the following stable cleaning/degreasing composition:

| Component | Wt. % |
|---|---|
| Lauramine N-oxide (30% actives) | 5.0 |
| Xanthan gum (Kelzan AR, Kelco Div. of Merck Co., 1.0% aq. solution) | 92.2 |
| Sodium metasilicate.$5H_2O$ | 2.0 |
| Acetic acid | 0.3 |
| Sodium nitrite | 0.5 |
| | 100.0 |

The procedure described in Example 17 was followed and the resulting composition was a pale yellow colored, translucent solution having a pH of 11.81 and a Brookfield viscosity (LV-#3 spindle, 12 rpm) of 2750 centipoise (day 0), 2740 (day 7) and 2730 (day 30). The composition exhibited excellent stability and vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 28 seconds.

EXAMPLE 19

Example 13 was repeated to produce the following stable cleaning/degreasing composition:

| Component | Wt. % |
|---|---|
| Potassium silicate (Kasil #6, 39.15% aq. solution) | 4.0 |
| Potassium hydroxide, 45% | 1.3 |
| Sodium nitrite | 0.5 |
| Soft $H_2O$ | 4.2 |
| | 10.0 |
| Octyldimethylamine N-oxide (40% actives) | 5.0 |
| Acusol 820 | 4.0 |
| Soft $H_2O$ | 81.0 |
| | 100.0 |

The procedure described in Example 13 was followed and the resulting composition was a very viscous, light bluish, irridescent solution having a pH of 11.68 and a Brookfield viscosity (LV-#3 spindle, 6 rpm) of 6480 centipoise. The composition was very stable and exhibited excellent cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 1.83 minutes.

EXAMPLE 20

A stable cleaning/degreasing concentrate formulation was prepared having the following composition:

| Component | Wt. % |
|---|---|
| Methyl vinyl ether/maleic anhydride copolymer (Gantrez AN-179, ISP Technologies, Inc., powder) | 4.0 |
| Lauramine N-oxide (30% actives) | 5.0 |
| Sodium metasilicate.$5H_2O$ | 2.0 |
| Sodium hydroxide, 50% | 3.0 |
| Sodium nitrite | 0.5 |
| Soft $H_2O$ | 85.5 |
| | 100.0 |

The Gantrez AN-179 was dispersed in water with stirring. While continuing stirring, the following were added in order: sodium hydroxide (immediate thickening and beginning of Gantrez AN-179 dissolution), metasilicate and nitrite. Stirring was continued until there was full dissolution of the Gantrez AN-179. Then the lauramine N-oxide was added with stirring. The resulting composition was a clear, viscous, very pale straw colored solution having a pH of 11.83 and a Brookfield viscosity (LV-#3 spindle, 12 rpm) of 2800 centipoise. It was very stable and exhibited excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 42 seconds.

EXAMPLE 21

A stable cleaning/degreasing formulation was prepared having the following composition:

| Component | Wt. % |
|---|---|
| Lauramidopropyldimethylamine N-oxide (Mackamine LAO, 30% actives) | 5.0 |
| Acusol 820 | 3.75 |
| Sodium metasilicate.$5H_2O$ | 2.0 |
| Sodium nitrite | 0.5 |
| Soft $H_2O$ | 88.75 |
| | 100.00 |

The Acusol 820 was added to water with stirring followed by the addition of the metasilicate, nitrite (instant thickening) and finally by the addition of the Mackamine LAO with stirring. The resulting composition was a clear, odorless, faintly bluish, irridescent gel having a pH of 12.11 and a Brookfield viscosity (LV-#4 spindle, 12 rpm) of 19,600 centipoise. The composition was very viscosity stable with excellent cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 2.33 minutes.

EXAMPLE 22

Example 21 was repeated to produce the following stable cleaning/degreasing composition:

| Component | Wt. % |
|---|---|
| Octyldimethylamine N-oxide (40% actives) | 5.0 |
| Acusol 820 | 3.75 |
| Sodium metasilicate.$5H_2O$ | 2.0 |
| Potassium nitrite | 0.5 |
| Soft $H_2O$ | 88.75 |
| | 100.00 |

The procedure described in Example 21 was followed and the resulting composition was a clear, colorless, faintly bluish, irridescent gel having a pH of 11.96 and a Brookfield viscosity (LV-#4 spindle, 12 rpm) of 16,700 centipoise. The composition was very stable and exhibited excellent cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 2.25 minutes.

EXAMPLE 23

Example 13 was repeated to produce the following stable cleaning/degreasing composition:

| Component | Wt. % |
|---|---|
| Postassium silicate (Kasil #6, 39.15% aq. solution) | 4.8 |
| Potassium hydroxide, 45% | 2.1 |
| Sodium nitrite | 0.5 |
| Soft $H_2O$ | 2.6 |
| | 10.0 |
| Cocodimethylamine N-oxide (30% actives) | 4.0 |
| Carboxyvinyl polymer (Polygel DA, 3V Corp. 1.0% aq. solution) | 72.0 |
| Soft $H_2O$ | 14.0 |
| | 100.0 |

The procedure described in Example 13 was followed and the resulting composition was a colorless, odorless, translucent (colloidal) solution having a pH of 12.08 and a Brookfield viscosity (LV-#3 spindle, 12 rpm) of 3940 centipoise. The composition was very stable and exhibited excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 30 seconds.

EXAMPLE 24

The following three compositions were formulated to contain three differing ratios of cocodimethylamine N-oxide (a tertiary amine N-oxide), Triton X-100 (a nonionic ethoxylate detergent) and Lonza Barquat CME-35 (N,N-cetyl ethyl morpholinium ethosulfate, a quaternary ammonium salt), the three components listed in U.S. Pat. Nos. 4,065,409, 4,174,304 and 4,203,872, and to compare such formulations with the composition of Example 2 above.

| Composition No. 1 | |
|---|---|
| Component | Wt. % |
| Cocodimethylamine N-oxide 30% actives) | 5.0 |
| Barquat CME-35, 35% actives | 2.0 |
| Triton X-100 | 2.0 |

-continued

| Composition No. 1 | |
|---|---|
| Component | Wt. % |
| Acusol 820 | 3.75 |
| Sodium metasilicate.$5H_2O$ | 2.0 |
| Sodium nitrite | 0.5 |
| Soft $H_2O$ | 84.75 |
| | 100.00 |

The Acusol 820 was added to water with stirring followed by the addition of the metasilicate and nitrite with stirring (instant thickening). Finally, added in order were the cocodimethylamine N-oxide, the Triton X-100 and Barquat CME-35 with stirring. The resulting composition was a bluish, irridescent solution with a pH of 12.14 and a Brookfield viscosity (LV-#2 spindle, 60 rpm) of 284 centipoise. The composition was very stable but exhibited very poor vertical cling properties.

The concentrate composition was subjected to the test described in Example 2A with the following results:

| Marking | % Removal |
|---|---|
| Texaco Motor Gear Lube Premium | 5% |
| Black felt tip Magic Marker | 90% |
| Skydrol hydraulic fluid, Grade LD-4 | 100% |
| Red (wax) china marker | 10% |
| #1 Graphite pencil | 30% |
| Takalube Outside Gear Lube | 15% |
| Mobil 28 Lithium Gear Lube (Synthetic) | 90% |
| Blue ballpoint pen | 100% |
| Composite score | 55% |

The concentrate composition at a dilution of 1:8 with water was subjected to the degreasing test method of Example 1 and produced a 100% degreasing time of 1.25 hours.

| Composition No. 2 | |
|---|---|
| Component | Wt. % |
| Cocodimethylamine N-oxide 30% actives) | 2.0 |
| Barquat CME-35, 35% actives | 5.0 |
| Triton X-100 | 2.0 |
| Acusol 820 | 3.75 |
| Sodium metasilicate.$5H_2O$ | 2.0 |
| Sodium nitrite | 0.5 |
| Soft $H_2O$ | 84.75 |
| | 100.00 |

The procedure described above for composition no. 1 was followed and the resulting composition was a deep, pronounced bluish, irridescent solution having a pH of 12.09 and a Brookfield viscosity (LV-#2 spindle, 60 rpm) of 89.5 centipoise. The composition was very stable, but exhibited very poor vertical cling properties.

The concentrate composition was subjected to the test described in Example 2A with the following results:

| Marking | % Removal |
|---|---|
| Texaco Motor Gear Lube Premium | <5% |
| Black felt tip Magic Marker | 90% |
| Skydrol hydraulic fluid, Grade LD-4 | 100% |

-continued

| Marking | % Removal |
|---|---|
| Red (wax) china marker | 30% |
| #1 Graphite pencil | 10% |
| Takalube Outside Gear Lube | 25% |
| Mobil 28 Lithium Gear Lube (Synthetic) | 95% |
| Blue ballpoint pen | 100% |
| Composite score | 57% |

The concentrate composition at a dilution of 1:8 with water was subjected to the degreasing test method of Example 1 and produced a 100% degreasing time of 1.58 hours.

| Composition No. 3 | |
|---|---|
| Component | Wt. % |
| Cocodimethylamine N-oxide 30% actives) | 2.0 |
| Barquat CME-35, 35% actives | 2.0 |
| Triton X-100 | 5.0 |
| Acusol 820 | 3.75 |
| Sodium metasilicate.$5H_2O$ | 2.0 |
| Sodium nitrite | 0.5 |
| Soft $H_2O$ | 84.75 |
| | 100.00 |

The procedure described above for composition no. 1 was followed and the resulting composition was a clear, slightly bluish, irridescent solution having a pH of 12.02 and a Brookfield viscosity (LV-#2 spindle, 60 rpm) of 200 centipoise. The composition was very stable, but exhibited very poor vertical cling properties.

The concentrate composition was subjected to the test described in Example 2A with the following results:

| Marking | % Removal |
|---|---|
| Texaco Motor Gear Lube Premium | 5% |
| Black felt tip Magic Marker | 90% |
| Skydrol hydraulic fluid, Grade LD-4 | 100% |
| Red (wax) china marker | 30% |
| #1 Graphite pencil | 20% |
| Takalube Outside Gear Lube | 40% |
| Mobil 28 Lithium Gear Lube (Synthetic) | 95% |
| Blue ballpoint pen | 90% |
| Composite score | 59% |

The concentrate composition at a dilution of 1:8 with water was subjected to the degreasing test method of Example 1 and produced a 100% degreasing time of 42 minutes.

EXAMPLE 25

A test soilant, a dispersion of decolorizing carbon (J. T. Baker, E344-7) in Skydrol hydraulic fluid, Grade LD-4 (Monsanto Co.), was baked onto an aluminum/magnesium alloy plate at 100° C. for approximately 72 hours in a forced draft air oven. The hydraulic fluid component was found to air/heat resinify on the plate surface to give a hard resin coating or fiim on cooling to room temperature, approximately 21° C.

This combination of suspended carbon in resinified Skydrol fluid closely resembles or simulates aircraft exhaust track and hydraulic fluid soils found on the aluminum/ magnesium alloy skin surrounding hot jet engines. These coverings become heavily soiled.

It was found that this test soilant was readily removed according to the test procedure of Example 2A using very light mopping or wiping action employing any of the compositions of Examples 2 or 6 through 23.

EXAMPLE 26

A stable, cleaning/degreasing concentrate formulation was prepared having the following composition:

| Component | Wt. % |
|---|---|
| Cocodimethylamine N-oxide 30% actives) | 2.0 |
| Acusol 820, 30% actives | 3.75 |
| Sodium metasilicate.$5H_2O$ | 2.0 |
| Sodium nitrite | 0.5 |
| Soft $H_2O$ | 91.75 |
| | 100.00 |

The Acusol 820 was added. to water with stirring followed by the addition of the metasilicate and nitrite with stirring (dissolution) and finally the cocodimethylamine N-oxide with continued stirring. The resulting composition was a clear, bluish, irridescent semi-gel (viscoelastic) having a pH of 12.05 and a Brookfield yiscosity (LV-#3 spindle, 6 rpm) of 13,360 centipoise. The composition was stable and exhibited excellent vertical cling properties.

The concentrate composition and a 1:1 dilution thereof with water were subjected to the test described in Example 2A and 100% removal of the soilants was observed at each concentration for each of the listed smears and markings. The concentrate composition at a 1:2 dilution with water was subjected to the test described in Example 2A with the following results:

| Marking | % Removal |
|---|---|
| Texaco Motor Gear Lube Premium | 80% |
| Black felt tip Magic Marker | 90% |
| Skydrol hydraulic fluid, Grade LD-4 | 100% |
| Red (wax) china marker | 90% |
| #1 Graphite pencil | 100% |
| Takalube Outside Gear Lube | 100% |
| Mobil 28 Lithium Gear Lube (Synthetic) | 100% |
| Blue ballpoint pen | 100% |
| Composite score | 95% |

The concentrate composition at a 1:4 dilution with water was subjected to the test described in Example 2A with the following results:

| Marking | % Removal |
|---|---|
| Texaco Motor Gear Lube Premium | 60% |
| Black felt tip Magic Marker | 85% |
| Skydrol hydraulic fluid, Grade LD-4 | 100% |
| Red (wax) china marker | 65% |
| #1 Graphite pencil | 100% |
| Takalube Outside Gear Lube | 85% |
| Mobil 28 Lithium Gear Lube (Synthetic) | 100% |
| Blue ballpoint pen | 100% |
| Composite score | 87% |

The test procedure of Example 2B was repeated with a 1:10 dilution with water of the concentrate composition with successful results. The concentrate composition diluted 1:8 with water was subjected to the degreasing test method of Example 1 and produced a 100% degreasing time of 1.33 minutes.

EXAMPLE 27

Example 26 was repeated to produce the following stable cleaning/degreasing composition:

| Component | Wt. % |
|---|---|
| Cocodimethylamine N-oxide 30% actives) | 10.0 |
| Acusol 820, 30% actives | 3.75 |
| Sodium metasilicate.$5H_2O$ | 2.0 |
| Sodium nitrite | 0.5 |
| Soft $H_2O$ | 84.25 |
| | 100.00 |

The procedure described in Example 26 was followed and the resulting composition was a clear, bluish, irridescent, thickened solution having a pH of 12.03 and a Brookfield viscosity (LV-#3 spindle, 12 rpm) of 1020 centipoise. The composition was very stable and exhibited fair vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 18 seconds.

EXAMPLE 28

A stable, cleaning/degreasing formulation was prepared having the following composition:

| Component | Wt. % |
|---|---|
| $C_{14}$–$C_{16}$ Alkyldimethylamine N-oxide (Ammonyx MCO, Stepan Co., 30% actives) | 5.0 |
| Acusol 820, 30% actives | 2.5 |
| Sodium metasilicate.$5H_2O$ | 2.0 |
| Sodium nitrite | 0.5 |
| Soft $H_2O$ | 90.00 |
| | 100.00 |

The Acusol 820 was added to water with stirring followed by the addition of the metasilicate and nitrite with stirring (dissolution and instant thickening) and finally the stirred addition of the Ammonyx MCO. The resulting composition was a clear, odorless, bluish irridescent solution having a pH of 12.48 and a Brookfield viscosity (LV-#3 spindle, 12 rpm) of 3550 centipoise. The composition was very viscosity stable and exhibited excellent vertical cling properties.

The above concentrate composition and 1:1, 1:2 and 1:4 dilutions thereof with wafer were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 42 seconds.

EXAMPLE 29

A stable, cleaning/degreasing formulation was prepared having the following composition:

| Component | Wt. % |
|---|---|
| Cocodimethylamine N-oxide 30% actives) | 5.0 |
| Colloidal magnesium aluminum silicate (Van Gel ES, R.T. Vanderbilt Co., Inc., 5.0% in soft $H_2O$) | 93.5 |
| Sodium metasilicate.$5H_2O$ | 1.0 |
| Sodium nitrite | 0.5 |
| Soft $H_2O$ | 0.5 |
| | 100.0 |

A 5.0 wt.% colloidal dispersion of colloidal magnesium aluminum silicate was prepared by adding the requisite amount of Van Gel ES to vigorously stirred soft water and maintaining this stirring for a total of 1 hour. The dispersion, beige in color, had a Brookfield viscosity (LV-#2 spindle, 60 rpm) of 93.5 centipoise and a pH of 8.98. The metasilicate and nitrite were added to the vigorously stirred dispersion of colloidal magnesium aluminum silicate (rapid thickening) followed by the stirred addition of the cocodimethylamine N-oxide. The resulting composition was an odorless, buff colored, opaic, viscous liquid having a pH of 12.21 and a Brookfield viscosity (LV-#3 spindle, 12 rpm) of 3800 centipoise. The composition was very stable and exhibited excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 35 seconds.

In order to demonstrate that the above formulated colloidal magnesium aluminum silicate composition does not harm plastic surface such as MILP-5425 acrylic, hard scrubbing of the latter with the above concentrate composition for up to 5 minutes with a shop towel wetted with the composition, followed by rinsing with water, left the surface as clean and bright as non-scrubbed areas.

EXAMPLE 30

A stable, cleaning/degreasing formulation was prepared having the following composition:

| Component | Wt. % |
|---|---|
| N,N-dimethyl(hydrogenated tallow alkyl) amine N-oxide (tallow = $C_{14}$–$C_{18}$, Aromax DMHT, Akzo Chemicals, Inc., 40% actives) | 4.5 |
| Carbopol 690 (1.0% aq. solution) | 92.0 |
| Sodium metasilicate.$5H_2O$ | 3.0 |

-continued

| Component | Wt. % |
|---|---|
| Potassium nitrite | 0.5 |
| | 100.0 |

The metasilicate and nitrite were added to the stirred aqueous Carbopol 690 solution (dissolution) followed by the stirred addition of the amine oxide. The resulting composition was a creamy, pearlescent liquid having a pH of 12.05 and a Brookfield viscosity (LV-#3 spindle, 12 rpm) of 7850 centipoise. The composition was very stable and exhibited excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 1.25 minutes.

EXAMPLE 31

Example 28 was repeated to produce the following stable, cleaning/degreasing composition:

| Component | Wt. % |
|---|---|
| Oleyldimethylamine N-oxide 35% actives) | 4.0 |
| Acrylic acid/alkyl(meth)acrylate copolymer (Alcogum SL-78, Alco Chemical, Div. of National Starch & Chemical Co., 30% actives) | 5.0 |
| Sodium metasilicate.$5H_2O$ | 2.3 |
| Sodium nitrite | 0.5 |
| Soft $H_2O$ | 88.2 |
| | 100.0 |

The procedure described in Example 28 was followed to produce a clear, odorless, bluish irridescent solution having a pH of 11.87 and a Brookfield viscosity (LV-#3 spindle, 12 rpm) of 1420 centipoise. The composition was very viscosity stable and exhibited good/excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 35 seconds.

EXAMPLE 32

A stable, cleaning/degreasing formulation was prepared having the following composition:

| Component | Wt. % |
|---|---|
| Isostearamidopropyl morpholine N-oxide morpholine N-oxide (Mackamine ISMO, McIntyre Group, Ltd., 25% actives) | 6.0 |
| Acusol 820, 30% actives | 2.0 |
| Sodium metasilicate.$5H_2O$ | 1.2 |
| Sodium nitrite | 0.5 |
| Soft $H_2O$ | 0.5 |
| | 100.0 |

The procedure described in Example 21 was followed to produce an odorless, somewhat bluish, translucent semi-gel having a pH of 12.01 and a Brookfield viscosity (LV-#3 spindle, 6 rpm) of 6200 centipoise. The composition was very stable and exhibited excellent vertical cling properties.

The concentrate composition and 1:1, 1:2 and 1:4 dilutions thereof with water were subjected to the test described in Example 2A and 100% removal of the soilants was observed at each concentration for each of the listed smears and markings, but at dilutions of 1:2 and 1:4 the ease of removal of Texaco Motor Gear Lube and Takilube was somewhat difficult to accomplish. The test procedure of Example 2B was repeated with 1:10 and 1:16 dilutions of the concentrate composition with water with successful results. The concentrate composition diluted 1:8 with water was subjected to the degreasing test method of Example 1 and produced a 100% degreasing time of 2.42 minutes.

EXAMPLE 33

Example 9 was repeated to produce the following stable, cleaning/degreasing composition:

| Component | Wt. % |
|---|---|
| Cocodimethylamine N-oxide 30% actives) | 4.5 |
| Carbopol 690 (1% aq. solution) | 93.6 |
| Sodium orthosilicate, anhydrous (Metso 200, PQ Corporation) | 1.4 |
| Potassium nitrite | 0.5 |
| | 100.0 |

The procedure described in Example 9 was followed and the resulting composition was an odorless, very slightly bluish/colloidal, otherwise clear solution having a pH of 12.48 and a Brookfield viscosity (LV-#3 spindle, 12 rpm) of 4920 centipoise. The composition was very stable and exhibited excellent vertical cling properties.

The concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions of the concentrate composition with water with successful re.suits. The concentrate composition diluted 1:8 with water was subjected to the degreasing test method of Example 1 and produced a 100% degreasing time of 40 seconds.

EXAMPLE 34

A stable, cleaning/degreasing formulation was prepared having the following composition:

| Component | Wt. % |
|---|---|
| Cocodimethylamine N-oxide 30% actives) | 6.0 |
| Carbopol 940 (1% aq. solution) | 75.0 |
| D-limonene | 0.95 |
| Sodium metasilicate.$5H_2O$ | 2.7 |
| Sodium nitrite | 0.5 |
| Soft $H_2O$ | 15.85 |
| | 100.00 |

The viscosifying polymer or thickener, 1% aqueous Carbopol 940, was prepared as a colloidal solution following the procedure given in Example 9 for Carbopol 690. The requisite amounts of 1% aqueous Carbopol 940 and water were mixed with stirring using a 3-bladed impetlor stirrer, motor-driven. To this colloidal solution were then added with stirring a mixture of the metasilicate and nitrite (instant thickening and dissolution of salts) followed by the addition of the amine oxide with stirring. When uniform in consistency, the D-limonene was added with stirring (emulsification). The resulting composition was a pale whitish, colloidal, thickened emulsion with a mild "orange peel" fragrance having a pH of 12.20 and a Brookfield viscosity (LV-#3 spindle, 12 rpm) of 3700 centipoise. The composition was very stable and exhibited excellent vertical cling properties.

The above concentrate composition and 1:1, 1:2 and 1:4 dilutions thereof with water were subjected to the test described in Example 2A and 100% removal of the soilants was observed at each concentration for each of the listed smears and markings. The test procedure of Example 2B was repeated with 1:10 and 1:16 dilutions with water of the concentrate composition with successful results. The concentrate composition at a dilution of 1:8 with water was subjected to the degreasing test method of Example 1 and produced a 100% degreasing time of 12 seconds.

The concentrate composition was applied to a soiled surface with the test soilant described in Example 25 and allowed to remain in place for 20 minutes at room temperature. Upon being subjected to hot water spray, the soilant was instantly removed providing a clean aluminum surface.

EXAMPLE 35

The concentrate composition of Example 2 was tested according to the aerospace specifications of the following: Douglas CSD #1, Boeing D6-17487 Rev. K, AMS 1533A, 1550A, 1526B and 1550A. These tests include effect on painted surfaces test, residue test, sandwich corrosion test, stress crazing test on acrylic plastics, immersion corrosion test, cadmium removal test, hydrogen embrittlement test, and effect on transparent acrylic plastics, painted surfaces and unpainted surfaces. In each instance, the concentrate composition of Example 2 was found to meet or conform to the required aerospace specifications.

In view of the above, it will be seen that the several objects of the invention are achieved and other advantageous results attained.

As various changes could be made in the above compositions without departing from the scope of the invention, it is intended that all matter contained in the above description shall be interpreted as illustrative and not in a limiting sense.

What is claimed is:

1. A stable, cleaning/degreasing concentrate composition for heavy duty exterior and interior aircraft cleaning and degreasing consisting essentially of:

(a) between approximately 0.5 and 10.0 weight percent of a tertiary amine N-oxide surfactant of the formula:

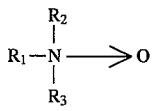

wherein $R_1$ contains a hydrophobe backbone having between 8 and 18 carbon atoms and is selected from the group consisting of alkyl, alkenyl, alkoxypropyl, alkylamidoalkyl and alkenylamidoalkyl of the formula:

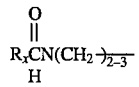

wherein $R_x$ is an alkyl or alkenyl hydrophobe backbone having between 8 and 18 carbon atoms, and $R_2$ and $R_3$ are selected from the group consisting of lower alkyl, hydroxethyl, and hydroxypropyl or $R_2$ and $R_3$ constitute a ring moiety selected from the group consisting of cyclic morpholino, pyrridino and piperidine;

(b) between approximately 0.5 and 5.0 weight percent of a water-dilutable, soluble or hydrocolloidally dispersable viscosifying agent selected from the group consisting of acrylic acid/alkyl (meth)acrylate copolymers, carboxy acrylic polymers, polyacrylic acid crosslinked with polyalkenyl polyethers, polyacrylamide, poly(methylvinyl ether/maleic anhydride), xanthan gums, bentonite clays, magnesium aluminum silicates, polyethylene glycols, polyethylene oxide, poly(styrene/maleic anhydride), poly(ethylene/maleic anhydride), poly (2-acrylamido-2-methyl-1-propanesulfonic acid) and poly(acrylic acid/acrylamide);

(c) between approximately 1 and 10 weight percent of an alkali metal silicate;

(d) between approximately 0.1 and 1.0 weight percent of an alkali metal nitrite; and (e) water;

said composition having a pH between approximately 10.5 and 13.3 and a Brookfield viscosity (LV-#3 spindle, 12 rpm) of between approximately 500 and 20,000 centipoise, and said composition being free from organic solvents.

2. A cleaning/degreasing composition as set forth in claim 1 wherein said composition contains between approximately 1.5 and 2.0 weight percent of said tertiary amine N-oxide surfactant.

3. A cleaning/degreasing composition as set forth in claim 1 wherein said composition contains between approximately 0.7 and 1.2 weight percent of said viscosifying agent.

4. A cleaning/degreasing composition as set forth in claim 1 wherein said composition contains between approximately 2 and 3 weight percent of said alkali metal silicate.

5. A cleaning/degreasing composition as set forth in claim 1 wherein said composition contains approximately 0.5 weight percent of said alkali metal nitrite.

6. A cleaning/degreasing composition as set forth in claim 1 wherein said composition has a Brookfield viscosity (LV-#3 spindle, 12 rpm) of between approximately 1,500 and 7,000 centipoise.

7. A cleaning/degreasing composition as set forth in claim 1 wherein said composition has a Brookfield viscosity (LV-#3 spindle, 12 rpm) of between 2,500 and 4,500 centipoise.

8. A cleaning/degreasing composition as set forth in claim 1 further diluted with water to the range between 1 part composition: 4 parts water and 1 part composition:16 parts water and having a Brookfield viscosity (LV-#2 spindle, 60 rpm) of between approximately 5 and 25 centipoise.

9. A cleaning/degreasing composition as set forth in claim 1 wherein said composition has a pH between approximately 11.5 and 12.5.

10. A cleaning/degreasing composition as set forth in claim 1 wherein said viscosifying agent is an acrylic acid/alkyl(meth)acrylate copolymer.

11. A cleaning/degreasing composition as set forth in claim 1 wherein said viscosifying agent is a polyacrylic acid crosslinked with polyalkenyl polyether.

12. A cleaning/degreasing composition as set forth in claim 1 wherein said viscosifying agent is poly(2-acrylamide-2-methyl-1-propanesulfonic acid).

13. A cleaning/degreasing composition as set forth in claim 1 wherein said viscosifying agent is a xanthan gum.

14. A cleaning/degreasing composition as set forth in claim 1 wherein said tertiary amine N-oxide surfactant is cocodimethylamine N-oxide.

15. A cleaning/degreasing composition as set forth in claim 1 wherein said tertiary amine N-oxide surfactant is lauryldimethylamine N-oxide.

16. A cleaning/degreasing composition as set forth in claim 1 wherein said tertiary amine N-oxide surfactant is oleyldimethylamine N-oxide.

17. A cleaning/degreasing composition as set forth in claim 1 wherein said tertiary amine N-oxide surfactant is dodecyldimethylamine N-oxide.

18. A cleaning/degreasing composition as set forth in claim 1 wherein said tertiary amine N-oxide surfactant is octyldimethylamine N-oxide.

19. A cleaning/degreasing composition as set forth in claim 1 wherein said alkali metal silicate is sodium metasilicate.

20. A cleaning/degreasing composition as set forth in claim 1 wherein said alkali metal nitrite is sodium nitrite.

21. A cleaning/degreasing composition as set forth in claim 1 which additionally contains one or more adjuvants selected from fragrances, dyes, opacifiers, chelants, acid scavengers and foam control agents.

22. A cleaning/degreasing composition for heavy duty exterior and interior aircraft cleaning and degreasing consisting essentially of approximately 1.5 weight percent of cocodimethylamine N-oxide, approximately 1.1 weight percent of an acrylic acid/alkyl (meth)acrylate copolymer, approximately 2.0 weight percent of sodium metasilicate, approximately 0.5 weight percent of sodium nitrite and the balance water, said composition being free from organic solvents.

23. A cleaning/degreasing composition for heavy duty exterior and interior aircraft cleaning and degreasing consisting essentially of approximately 0.9 weight percent of cocodimethylamine N-oxide, approximately 0.8 weight percent of octyldimethylamine N-oxide, approximately 1.1 weight percent of an acrylic acid/alkyl (meth)acrylate copolymer, approximately 2.0 weight percent of sodium metasilicate, approximately 0.5 weight percent of sodium nitrite and the balance water, said composition being free from organic solvents.

24. A cleaning/degreasing composition for heavy duty exterior and interior aircraft cleaning and degreasing consisting essentially of approximately 1.35 weight percent of lauryldimethylamine N-oxide, approximately 0.92 weight percent of a polyacrylic acid crosslinked with a polyalkenyl polyether, approximately 3.2 weight percent of sodium metasilicate, approximately 0.5 weight percent of sodium nitrite and the balance of water, said composition containing no solvent.

25. A cleaning/degreasing composition for heavy duty exterior and interiorsaircraft cleaning and degreasing consisting essentially of approximately 1.35 weight percent of cocodimethylamine N-oxide, approximately 0.94 weight percent of a xanthan gum, approximately 1.0 weight percent of sodium metasilicate, approximately 0.5 weight percent of potassium nitrite and the balance water, said compositon being free from organic solvents.

* * * * *